US006423911B2

(12) United States Patent
Yoshida et al.

(10) Patent No.: US 6,423,911 B2
(45) Date of Patent: Jul. 23, 2002

(54) MULTI-DIRECTIONAL OPERATING SWITCH CAPABLE OF BEING OPERATED IN BOTH DEPRESSING DIRECTION AND TILTING DIRECTION

(75) Inventors: Toshihiro Yoshida; Kazuyoshi Kagawa, both of Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/731,353

(22) Filed: Dec. 6, 2000

(30) Foreign Application Priority Data

Dec. 16, 1999 (JP) ..... 11-357753

(51) Int. Cl.[7] ..... H01H 25/06
(52) U.S. Cl. ..... 200/6 A; 200/406
(58) Field of Search ..... 200/6 A, 1 B, 200/406

(56) References Cited

U.S. PATENT DOCUMENTS 3,927,285 A * 12/1975 Frost et al. ..... 200/6 A
4,122,319 A * 10/1978 Jamet ..... 200/1 B
5,889,242 A 3/1999 Ishihara et al. ..... 200/6 A
6,160,225 A * 12/2000 Isikawa ..... 200/6 A X
6,201,196 B1 * 3/2001 Wergen ..... 200/6 A

* cited by examiner

*Primary Examiner*—Renee Luebke
(74) *Attorney, Agent, or Firm*—Brinks Hofer Gilson & Lione

(57) ABSTRACT

A multi-directional operating switch is disclosed, comprising a housing having a bottomed receptacle portion, a central fixed contact portion disposed on an inner bottom surface of the receptacle portion, peripheral fixed contact portions disposed on a peripheral surface with respect to the central fixed contact portion, a plurality of movable contacts disposed respectively in opposition to the central and peripheral fixed contact portions, and a step for depressing the plural movable contacts selectively to switch over from one contact to another, wherein the movable contacts are disposed within the receptacle portion of the housing in such a manner that in the depressing direction of the stem the movable contact disposed in opposition to the central fixed contact portion and the movable contacts disposed in opposition to the peripheral fixed contact portions are spaced a predetermined distance from each other, while in a direction perpendicular to the stem depressing direction they partially overlap each other in their external forms.

20 Claims, 5 Drawing Sheets

MULTI-DIRECTIONAL OPERATING SWITCH CAPABLE OF BEING OPERATED IN BOTH DEPRESSING DIRECTION AND TILTING DIRECTION

BACKGROUND OF THE INVENTION

1. Field of the Invention

The present invention relates to a structure of a multi-directional operating switch and more particularly to a structure of a multi-directional operating switch provided with plural switch contacts and a stem which can be operated in both depressing direction and tilting direction selectively.

2. Description of the Prior Art

As a conventional structure of a multi-directional operating switch there is known such a structure as shown in FIGS. 7 and 8, of which FIG. 7 is a vertical sectional view of a multi-directional operating switch and FIG. 8 is a plan view with movable contacts mounted in a housing.

In both figures, a housing 11 is formed in the shape of a bottomed box using an insulating material such as a synthetic resin, an upper side of the box being open. A central fixed contact portion 12 formed of an electrically conductive metallic material is disposed at a central of an inner bottom of the housing 11. On both opposed sides of the central fixed contact portion 12 are disposed a pair of peripheral fixed contact portions 13 also formed of an electrically conductive metallic material.

The central fixed contact portion 12 and each peripheral fixed contact portion 13 are constituted by a pair of contact pieces 12*a*, 12*b* and a pair of contact pieces 13*a*, 13*b*, respectively.

On the upper surface sides of the central fixed contact portion 12 and the peripheral fixed contact portions 13 are disposed movable contacts 14 each constituted by an electrically conductive metallic disc. The movable contacts 14 are each formed in a centrally expanded dome shape.

A stem 15 is formed of an insulating material such as a synthetic resin and is composed of a first stem 16 which constitutes a base portion and a second stem 17 which is disposed centrally of the first stem 16 so as to be movable in a depressing direction.

At both underside ends of the first stem 16 are formed a pair of depressing protuberances 16*b*, which are respectively in abutment against the movable contacts 14 disposed on the upper surface sides of the peripheral fixed contact portions 13. With a tilting operation of the stem 15, the corresponding movable contact 14 is depressed and the contact pieces 13*a* and 13*b* of the associated peripheral fixed contact portion 13 are rendered conductive with each other through the movable contact 14.

The second stem 17 is inserted into an insertion hole 16*a* formed in the first step 16 and a rod-like portion projects from the insertion hole 16*a* and is used an operating rod portion 17*a*, with a depressing protuberance 17*b* being formed on the side opposite to the operating rod portion 17*a*. The depressing protuberance 17*b* is in abutment against the movable contact 14 disposed on the upper surface side of the central fixed contact portion 12. When the operating rod portion 17*a* is depressed, the depressing protuberance 17*b* depresses the movable contact 14, causing the contact pieces 12*a* and 12*b* of the central fixed contact portion 12 to become conductive with each other through the movable contact 14.

A cover 18 is formed by a metallic plate, with a window hole 18*a* being formed therein centrally for insertion therethrough of the operating rod portion 17*a* of the stem 15. The cover 18 covers the upper-side opening of the housing 11 to prevent the movable contacts 14 and the stem 15 from jumping out of the housing.

In the above conventional structure of a multi-directional operating switch, however, the central fixed contact portion 12 and the peripheral fixed contact portions 13 are formed in the same plane as the inner bottom of the housing 11, and also as to the movable contacts, it is necessary for them to be disposed in the same plane as the central fixed contact portion 12 and the peripheral fixed contact portions 13 correspondingly thereto. Thus, it is necessary that the movable contacts 14 be arranged at certain intervals so as not to strike against one another. In other words, it is impossible to reduce the size of the housing 11 and hence impossible to reduce the width of the switch body.

SUMMARY OF THE INVENTION

Accordingly, it is an object of the present invention to solve the above-mentioned problems and provide a structure of a multi-directional operating switch wherein a movable contact disposed over a central fixed contact portion and movable contacts disposed over peripheral fixed contact portions can be positioned overlapping each other so that their switching operations may not interfere with one another, thus permitting the reduction in width of a switch body.

For achieving the above-mentioned object, according to a first aspect of the present invention there is provided a multi-directional operating switch comprising a housing having a bottomed receptacle portion, a central fixed contact portion disposed on an inner bottom surface of the receptacle portion, peripheral fixed contact portions disposed at peripheral positions with respect to the central fixed contact portion, a plurality of movable contacts disposed in opposition to the central fixed contact portion and the peripheral fixed contact portions, and a stem for depressing the plural movable contacts selectively to switch over the contacts from one to another, wherein the movable contacts are disposed within the receptacle portion of the housing in such a manner that in the depressing direction of the stem the movable contact disposed in opposition to the central fixed contact portion and the movable contacts disposed in opposition to the peripheral fixed contact portions are spaced a predetermined distance from each other, while in a direction perpendicular to the stem depressing direction they partially overlap each other in their external forms.

According to a second aspect of the present invention there is provided, in combination with the above first means, a multi-directional operating switch wherein the inner bottom surface of the receptacle portion of the housing comprises a first inner bottom surface for disposing the central fixed contact portion thereon and a second inner bottom surface for disposing the peripheral fixed contact portions thereon, the first and second inner bottom surfaces being different in height from each other.

According to a third aspect of the present invention there is provided, in combination with the above second means, a multi-directional operating switch wherein the first inner bottom surface is formed higher than the second inner bottom surface.

According to a fourth aspect of the present invention there is provided, in combination with the above second means, a multi-directional operating switch wherein the first inner bottom surface is formed lower than the second inner bottom surface.

Further, the stem can be operated in both depressing direction and tilting direction selectively so that when the stem is depressed, the movable contact opposed to the central fixed contact portion is depressed to turn ON the central fixed contact portion, while when the stem is tilted, the movable contact opposed to the peripheral fixed contact portion is depressed and turns ON the peripheral fixed contact portion.

DESCRIPTION OF PREFERRED EMBODIMENTS

Figure 1:
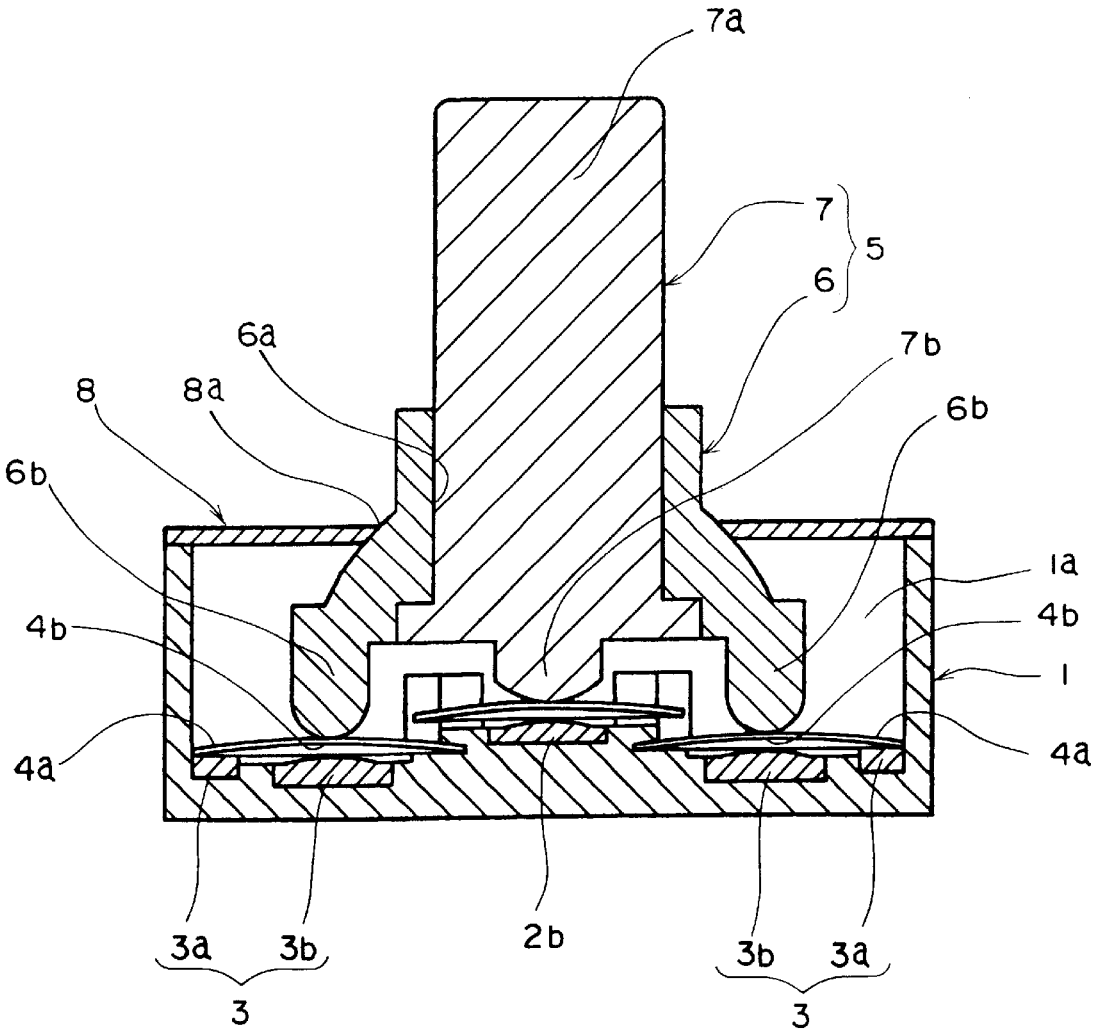
FIG. 1 is a vertical sectional view of a multi-directional operating switch according to the first embodiment of the present invention.
Figure 2:
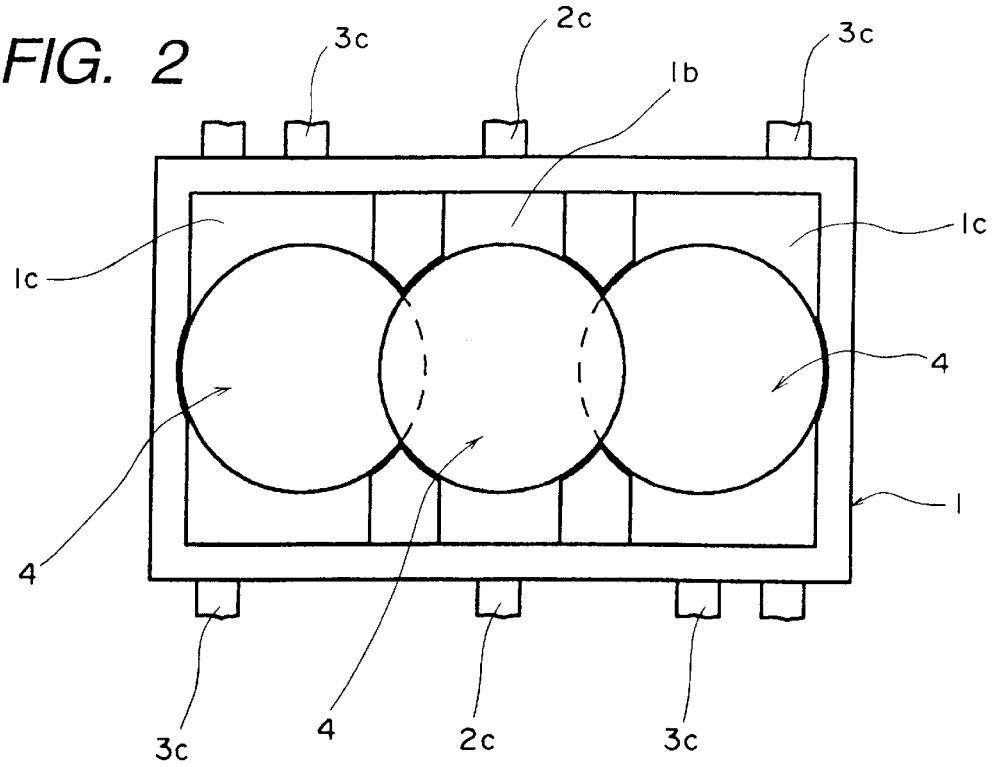
FIG. 2 is a plan view showing a state in which movable contacts are disposed in a housing of the switch.
Figure 3:
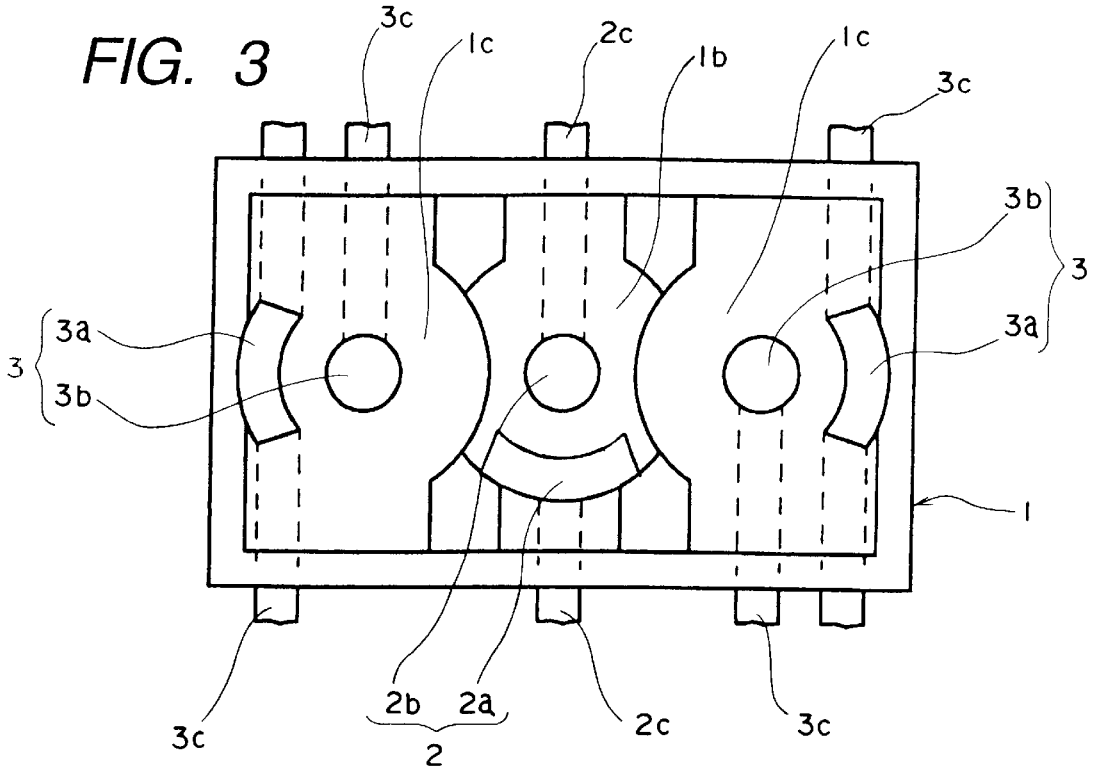
FIG. 3 is a plan view showing the housing.

Embodiments of the present invention are illustrated in FIGS. 1 to 6, in which FIGS. 1 to 3 illustrate a structure of a multi-directional operating switch according to the first embodiment of the present invention, FIG. 1 being a vertical sectional view of the switch, FIG. 2 being a plan view showing a state in which movable contacts are disposed in a housing, and FIG. 3 being a plan view of the housing.

In FIGS. 1 to 3, a housing 1 is formed in the shape of a bottomed box using an insulating material such as a synthetic resin, an upper side of the box being open. In the housing 1 is formed a receptacle portion 1*a*, and a central fixed contact portion 2 formed of an electrically conductive metallic material is disposed at a central of an inner bottom surface of the receptacle portion 1*a*. On both opposed sides of the central fixed contact portion 2 are disposed a pair of peripheral fixed contact portions 3 also formed of an electrically conductive metallic material. The central fixed contact portion 2 and each of the peripheral fixed contact portions 3 are composed of a pair of contact pieces 2*a* and 2*b* and a pair of contact pieces 3*a* and 3*b*, respectively.

The inner bottom surface of the receptacle portion 1*a* comprises a first inner bottom surface 1*b* on which the central fixed contact portion 2 is disposed and second inner bottom surfaces 1*c* on which the peripheral fixed contact portions 3 are disposed respectively, the first and second inner bottom surfaces being formed so as to be different in height from each other. The inner bottom surface 1*b* is formed at a position higher than the second inner bottom surfaces 1*c*. That is, the central fixed contact portion 2 is disposed on the inner bottom surface of the receptacle portion 1*a* so as to be positioned higher than the peripheral fixed contact portions 3.

Connecting terminals 2*c* and 3*c* are drawn out from the central fixed contact portion 2 and the peripheral fixed contact portions 3 and are projected outwards from side faces of the housing 1 for connection with circuit patterns formed on a circuit board of an electronic device (not shown) for example.

Movable contacts 4 each constituted in a centrally expanded dome shape by an electrically conductive metallic disc are disposed on the first and second inner bottom surfaces 1*b*, 1*c*. The movable contacts 4 are disposed so as to cover the upper surface sides of the central and peripheral fixed contact portions 2, 3. In this case, peripheral edge portions 4*a* of the movable contacts 4 are kept in contact with one contact pieces 2*a* and 3*a* of the central and peripheral fixed contact portions 2, 3, while their dome-like tops 4*b* are spaced a predetermined distance from the other contact pieces 2*b* and 3*b*. In this state, the central and peripheral fixed contact portions 2, 3 are OFF.

The movable contacts 4 disposed on the upper surface sides of the central and peripheral fixed contact portions 2, 3 are positioned within the receptacle portion 1*a* of the housing 1 in such a manner that in a depressing direction (vertical direction) of a stem 5 which will be described later the movable contact 4 disposed on the upper surface side of the central fixed contact portion 2 and the movable contacts disposed on the upper surface sides of the peripheral fixed contact portions 3 are spaced a predetermined distance, i.e., different in height, from each other, while in a direction (horizontal direction) perpendicular to the stem depressing direction (vertical direction) they partially overlap each other in their external forms. With this arrangement, it is no longer required to increase the width of the housing 1 to match the overall size of the movable contacts 4.

The stem 5, which is formed of an insulating material such as a synthetic resin, comprises a first stem 6 which constitutes a base portion and a second stem 7 which is engaged with a central part of the first stem 6 so as to be movable in the stem depressing direction. The first and second stems 6, 7 are formed so that both can operate in one piece with each other upon a tilting motion of the stem 5.

In the first stem 6 is formed an insertion hole 6*a* for insertion therein of the second stem 7, and a pair of depressing protuberances 6*b* are formed at both underside ends of the first stem. The first stem 6 is received within the receptacle portion 1*a* of the housing 1 in an abutted state of its depressing protuberances 6*b* against the tops 4*b* of the movable contacts 4 which are disposed on the upper surface sides of the peripheral fixed contact portions 3. As the stem 5 tilts, the depressing protuberance 6*b* located in the tilting direction depresses the top 4*b* of the corresponding movable contact 4, causing the contact pieces 3*a* and 3*b* of the peripheral fixed contact portion 3 opposed thereto to become conductive with each other through the movable contact 4.

The second stem 7 is engaged with the first stem 6 by being inserted into the insertion hole 6*a* of the first stem. A rod-like portion of the second stem 7 projects as an operating rod portion 7*a* from the insertion hole 6*a*, while on the side opposite to the operating rod portion 7*a* of the second stem 7 is formed a depressing protuberance 7*b* which projects from the underside of the first stem 6. The depressing protuberance 7*b* is in abutment against the top 4*b* of the movable contact 4 disposed on the upper surface side of the central fixed contact portion 2. When the operating rod portion 7*a* is depressed, the depressing protuberance 7*b* depresses the top 4*b* of the said movable contact 4, causing the contact pieces 2*a* and 2*b* of the central fixed contact portion 2 to become conductive with each other through the movable contact 4. At this time, the second stem 7 slides in the depressing direction through the insertion hole 6*a* of the first stem 6, with no movement of the first stem.

A cover 8 formed in a rectangular shape using a metallic plate is attached to the upper open side of the receptacle portion 1*a* of the housing 1, with a window hole 8*a* being formed centrally of the cover 8 for insertion therethrough of the operating rod portion 7*a* of the stem 5. Since the upper open side of the housing 1 is covered with cover 8, the movable contacts 4 and the stem 5 are prevented from jumping out of the housing.

The following description is now provided about the operation of the multi-directional operating switch of this embodiment described above.

First, in connection with the depressing operation of the switch, when the second stem 7 of the stem 5 is depressed vertically with a finger or the like, the second stem 7 moves in the same direction through the insertion hole 6*a* of the first stem 6 and the depressing protuberance 6*b* depresses the top 4*b* of the movable contact 4 positioned over the central fixed contact portion 2, so that the dome-like expanded top 4*b* is inverted into contact with the contact piece 2*b* of the central fixed contact portion 2, whereby the contact pieces 2*a* and 2*b* become conductive with each other through the movable contact 4 and the central fixed contact portion 2 turns ON. In this case, the first stem 6 does not follow up the operation of the second stem 7, so that the peripheral fixed contact portions 3 remain OFF. In this state, if the finger pressure is relieved, the movable contact 4 inverts itself and reverts to its initial state, so that the second stem 7 reverts to its initial position.

Reference will now be made to a tilting operation of the switch. If the second stem 7 is tilted sideways with a finger or the like, the first stem 6 tilts sideways following the tilting motion of the second stem 7. Consequently, the depressing protuberance 6*b* of the first stem 6 located in the tilted direction depresses the top 4*b* of the movable contact 4 disposed over the peripheral fixed contact portion 3 on the tilted side. As a result, the dome-like expanded top 4*b* of the movable contact 4 is inverted into contact with the contact piece 3*b* of the peripheral fixed contact portion 3, thus causing the contact pieces 3*a* and 3*b* to become conductive with each other through the movable contact 4 and the peripheral fixed contact portion 3 turns ON. In this case, the second stem 7 also tilts sideways, but the depressing protuberance 7*b* of the second stem 7 does not move vertically, therefore, the central fixed contact portion 2 is not depressed, but remains OFF.

In this state, if the finger's sideways pressure is relieved, the movable contact 4 inverts itself and reverts to its initial state, so that the first stem 6 reverts to its initial position.

The sideways tilting motion can be done in each of both right and left directions in the same manner as above and therefore an explanation thereof in the opposite direction will be omitted.

In the structure of the multi-directional operating switch according to the present invention, as described above, the inner bottom surface of the receptacle portion 1*a* of the housing 1 is stepped, the central fixed contact portion 2 and the peripheral fixed contact portions 3 are disposed on the stepped inner bottom surfaces respectively, and the movable contacts 4 disposed on the upper surface sides of the central and peripheral fixed contact portions 2, 3 are positioned within the housing receptacle portion 1*a* in such a manner that the movable contact 4 disposed over the central fixed contact portion 2 and the movable contacts 4 disposed over the peripheral fixed contact portions 3 partially overlap each other in their external forms, therefore, the width of the housing 1 can be reduced without being restricted by the overall size of the movable contacts 4.

Moreover, as a positioning structure for the movable contacts 4, the inner bottom of the housing 1 comprises the first inner bottom surface 1*b* for disposing the central fixed contact portion 2 thereon and the second inner bottom surfaces 1*c* for disposing the peripheral fixed contact portions 3 thereon, and the first and second inner bottom surfaces 1*b*, 1*c* are stepped with respect to each other, thereby spacing the movable contacts 4 from each other, whereby it is possible to prevent the movable contacts from interfering with each other. Besides, reliable switch contact portions can be formed by a simple structure.

Further, in the multi-directional operating switch using such plural movable contacts 4 as described above, the reduction in size of the switch body can be attained because the switch contact portions can be formed small in size.

Figure 4:
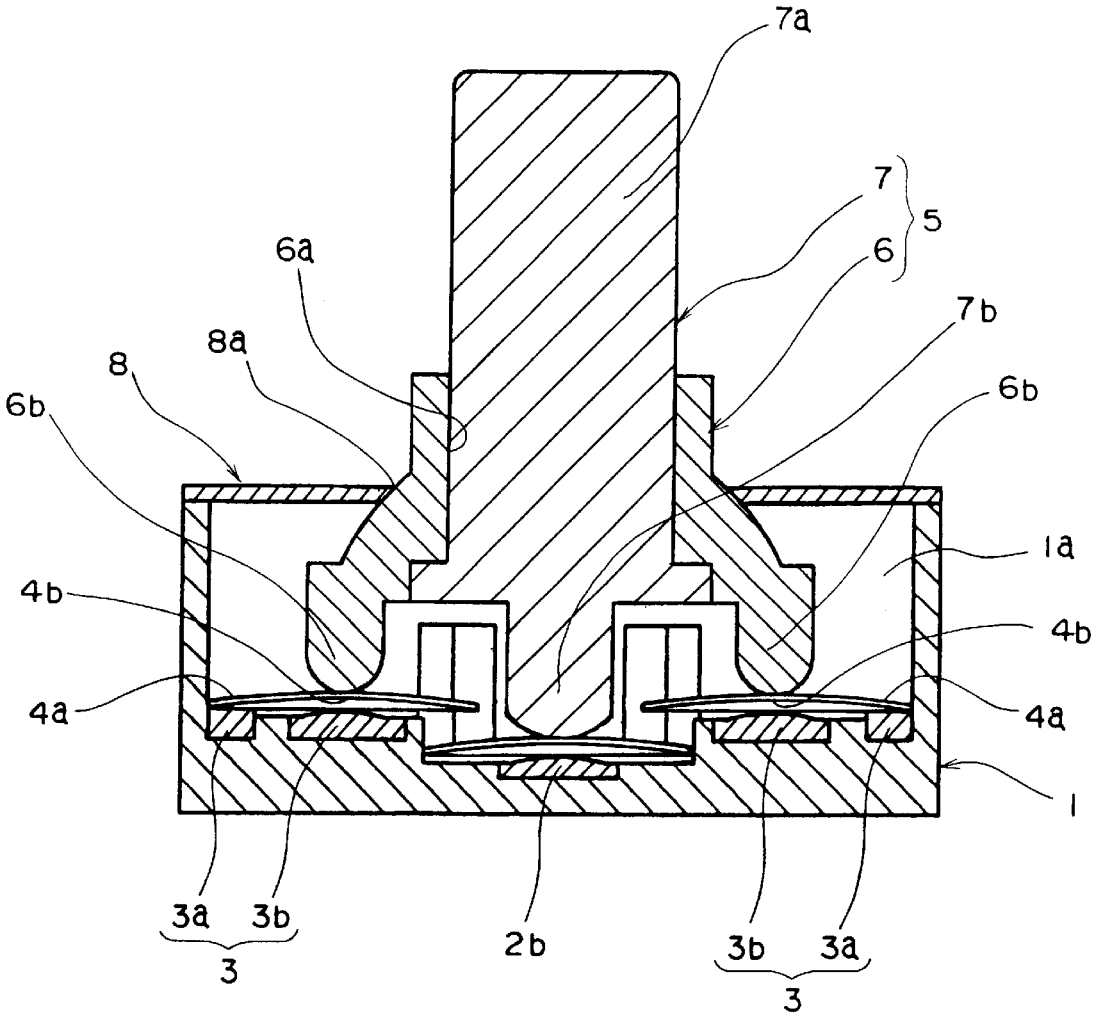
FIG. 4 is a vertical sectional view of a multi-directional operating switch according to the second embodiment of the present invention.
Figure 5:
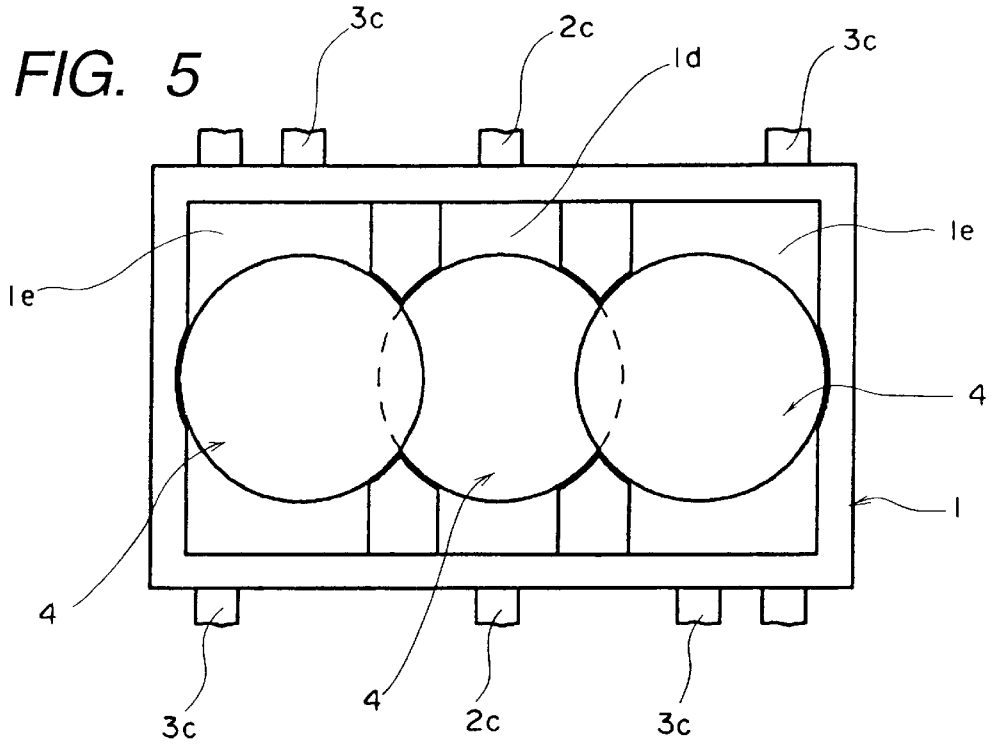
FIG. 5 is a plan view showing a state in which movable contacts are disposed in a housing of the switch.
Figure 6:
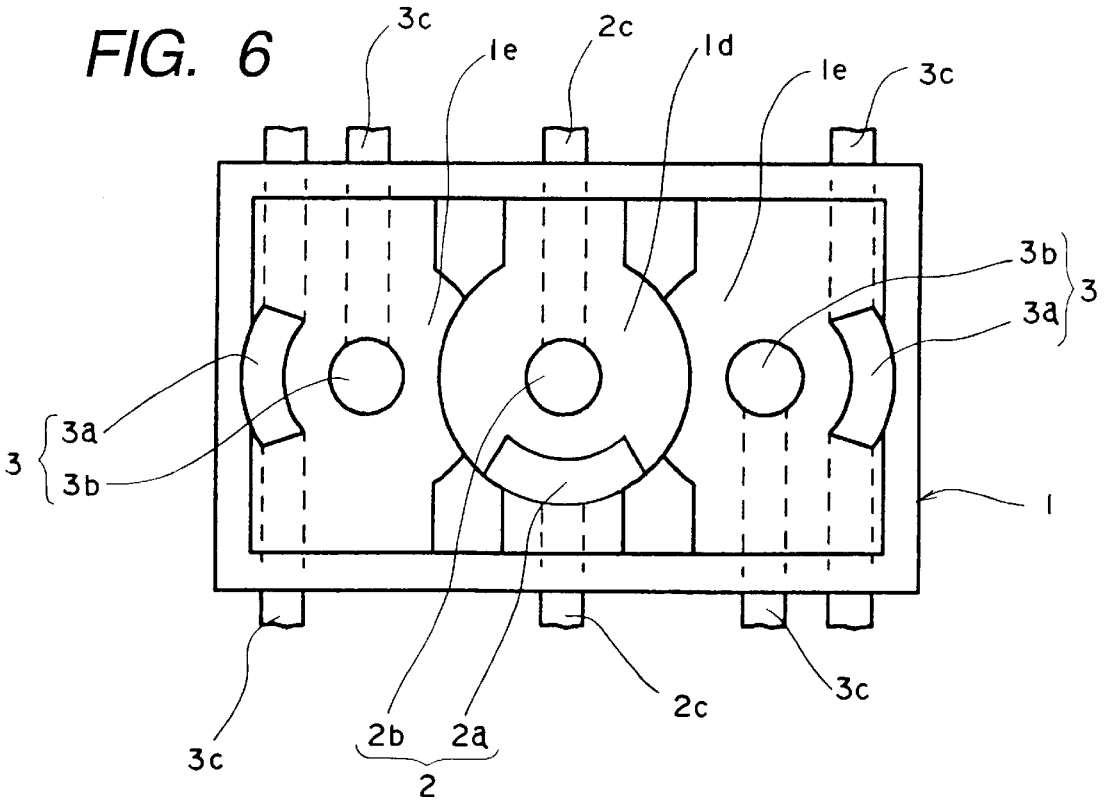
FIG. 6 is a plan view showing the housing.
Figure 7:
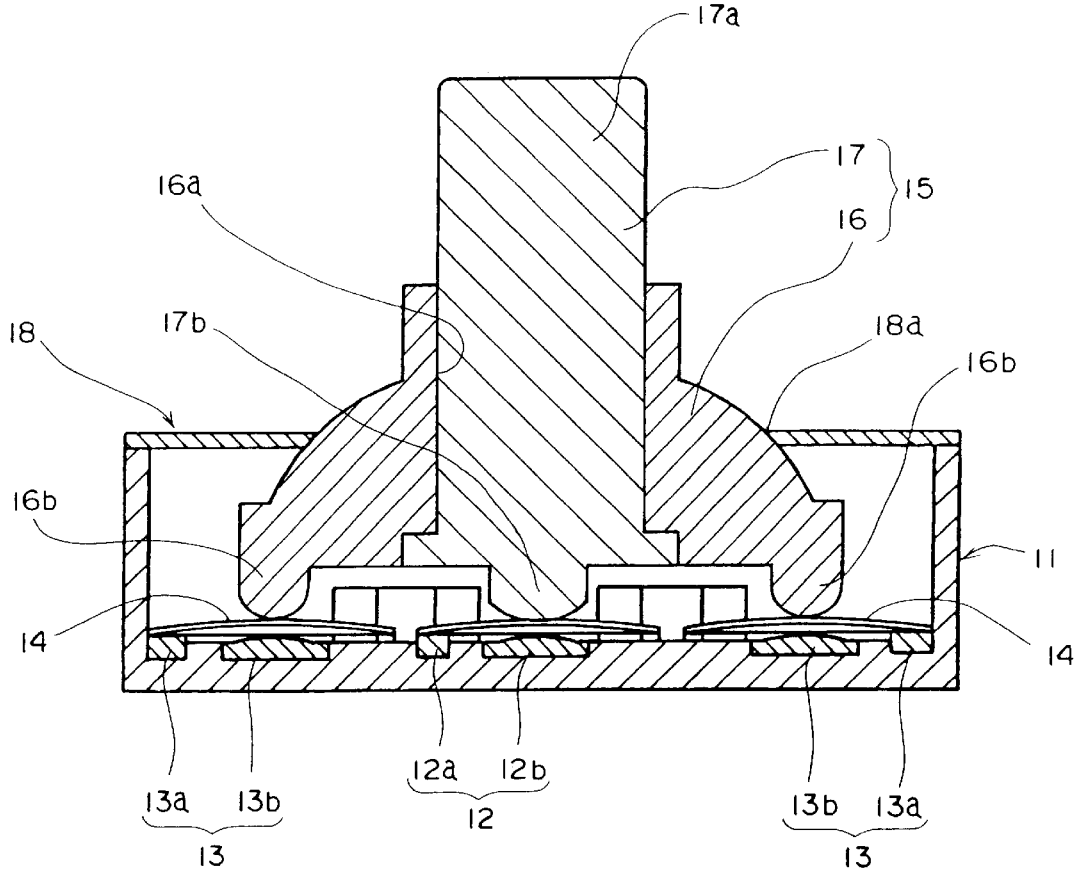
FIG. 7 PRIOR ART
FIG. 7 is a vertical sectional view of a conventional multi-directional operating switch.
Figure 8:
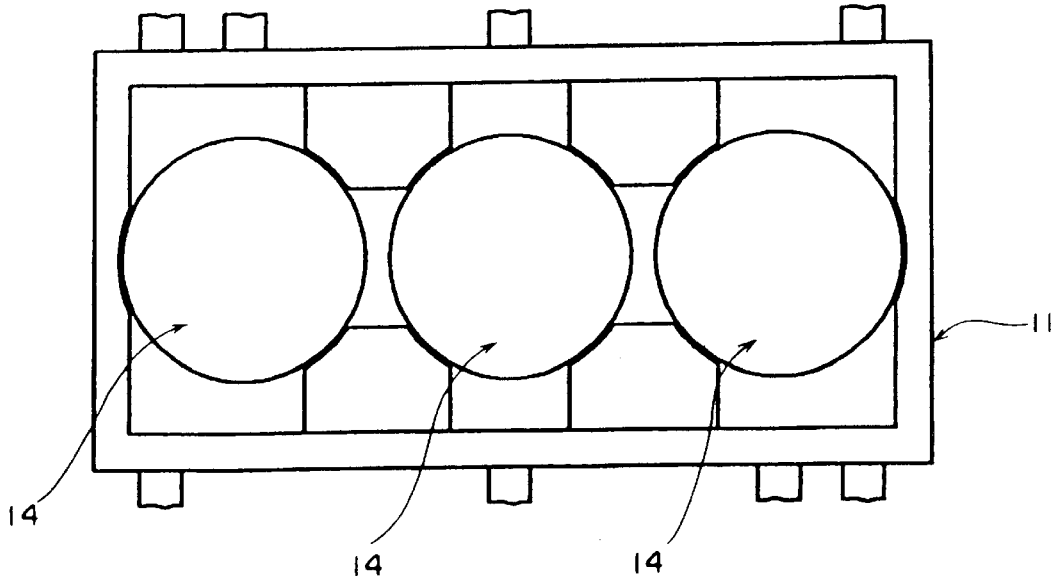
FIG. 8 PRIOR ART
FIG. 8 is a plan view showing a state in which movable contacts are disposed in a housing of the conventional switch.

FIGS. 4 to 6 illustrate a multi-directional operation switch according to the second embodiment of the present invention, of which FIG. 4 is a vertical sectional view of the switch, FIG. 5 is a plan view of a housing with movable contacts disposed therein, and FIG. 6 is a plan view of the housing.

The same components as in FIGS. 1 to 3 will be identified by the same reference numerals as in those figures and explanations thereof will here be omitted.

This second embodiment is different from the previous first embodiment in that a stepped structure of an inner bottom surface of a housing receptacle portion 1*a* is somewhat different from that in the first embodiment. The multi-directional operating switch of the second embodiment has a stepped inner bottom structure of the receptacle portion 1*a* such that a first inner bottom surface 1*d* with the central fixed contact portion 2 formed thereon is lower than second inner bottom surfaces 1*e* with the peripheral fixed contact portions 2 formed thereon. That is, the central and peripheral fixed contact portions 2, 3 are disposed on the inner bottom surface of the receptacle portion 1*a* so that the central fixed contact portion 2 is positioned lower than the peripheral fixed contact portions 3.

The movable contacts 4 disposed on the upper surface sides of the central and peripheral fixed contact portions 2, 3 are positioned within the receptacle portion 1*a* of the housing 1 in such a manner that in the depressing direction (vertical direction) of the stem 5 the movable contact 4 disposed on the upper surface side of the central fixed contact portion 2 and the movable contacts disposed on the upper surface sides of the peripheral fixed contact portions 3 are spaced a predetermined distance from each other in a stepped fashion, while in a direction (horizontal direction) perpendicular to the stem depressing direction they partially overlap each other in their external forms. This arrangement no longer requires increasing the width of the housing 1 to match the overall size of the movable contacts 4, but permits the reduction in width of the housing without being restricted by the size of the movable contacts.

In this second embodiment the movable contacts 4 are arranged in such a manner that the movable contacts 4 positioned on the upper surface sides of the peripheral fixed contact protons 3 overlap the movable contact 4 positioned on the upper surface side of the central fixed contact portion 2 at respective positions higher than the central movable contact.

Also in this second embodiment the inner bottom surface of the receptacle portion 1*a* of the housing 1 is stepped and the central and peripheral fixed contact portions 2, 3 are disposed on the stepped inner bottom surfaces respectively, further, the movable contacts disposed on the upper surface sides of the central and peripheral fixed contact portions 2, 3 are received within the housing receptacle portion 1*a* so as to partially overlap each other in their external forms, thus permitting the reduction in width of the housing 1 without being restricted by the size of the movable contacts 4.

Moreover, as a positioning structure for the movable contacts 4, the inner bottom surface of the housing 1 is formed with the inner bottom surface 1*d* with the central fixed contact portion 2 disposed thereon and the inner bottom surfaces 1*e* with the peripheral fixed contact portions 3 disposed thereon, and a stepped boundary is defined between the first and second inner bottom surfaces 1*d*, 1*e* to space the central movable contact and the peripheral movable contacts from each other, whereby it is possible to prevent interference of the movable contacts 4. Besides, reliable switch contact portions can be formed by a simple structure.

Further, in the multi-directional operating switch using plural such movable contacts 4, the switch contact portions can be formed small and hence it becomes possible to reduce the size of the switch body.

Although in the above embodiments the peripheral fixed contact portions 3 are disposed in two right and left positions, the present invention is not limited to such a structure. It goes without saying that the invention is also applicable to a multi-directional operating switch wherein a peripheral fixed contact portion is disposed in only one of right and left directions, a like switch wherein peripheral fixed contact portions are disposed in four right, left and upward, downward directions, and a like switch wherein peripheral fixed contact portions are arranged in eight directions.

In the multi-directional operating switch structure according to the present invention, as set forth above, the movable contacts opposed respectively to the central and peripheral fixed contact portions are disposed on the inner bottom surface of the housing receptacle portion so that in the stem depressing direction they are spaced a predetermined distance from each other, while in a direction perpendicular to the stem depressing direction they partially overlap each other in their external forms. Therefore, it is not necessary to increase the width of the housing in conformity with the size of the movable contacts, thus permitting the reduction in width of the housing without being restricted by the size of the movable contacts.

Besides, the inner bottom surface of the housing receptacle portion is formed with the first inner bottom surface with the central fixed contact portion disposed thereon and the second inner bottom surface with the peripheral fixed contact portions disposed thereon, and a stepped boundary is formed between the first and second inner bottom surfaces, thus permitting the movable contacts to be spaced from one another within the housing receptacle portion, and therefore it is possible to prevent mutual interference of the movable contacts.

Moreover, since the first inner bottom surface is formed higher than the second inner bottom surface, there can be obtained reliable switch contact portions by a simple structure.

Likewise, in the case where the first inner bottom surface is formed lower than the second inner bottom surface, there also can be obtained reliable switch contact portions by a simple structure.

Further, the stem can be operated selectively in both depressing direction and tilting direction, and when the stem is operated in its depressing direction, the movable contact disposed in opposition to the central fixed contact portion is depressed to turn ON the central fixed contact portion, while when the stem is tilted, the movable contact disposed in opposition to the peripheral fixed contact portion located in the tilted direction is depressed to turn ON the peripheral fixed contact portion. Therefore, in the multi-directional operating switch using plural such movable contacts, the switch contact portions can be formed small and hence it becomes possible to reduce the size of the switch body.

What is claimed is:

1. A multi-directional operating switch comprising:

a housing having a bottomed receptacle portion;

a central fixed contact portion disposed on an inner bottom surface of the receptacle portion;

peripheral fixed contact portions disposed at peripheral positions with respect to the central fixed contact portion;

a plurality of movable contacts disposed in opposition to the central fixed contact portion and the peripheral fixed contact portions; and a stem for depressing the plurality of movable contacts selectively to contact with one of the central fixed contact portion and the peripheral fixed contact portions, wherein the movable contacts are disposed within the receptacle portion of the housing in such a manner that in the depressing direction of the stem the movable contact disposed in opposition to the central fixed contact portion and the movable contacts disposed in opposition to the peripheral fixed contact portions are spaced a predetermined distance from each other, while in a direction perpendicular to the stem depressing direction they partially overlap each other in their external forms, and wherein the stem can be selectively operated in both depressing direction and tilting direction so that when the stem is depressed, the movable contact disposed in opposition to the central fixed contact portion is depressed to turn ON the central fixed contact portion, while when the stem is tilted, the movable contact disposed in opposition to one of the peripheral fixed contact portions is depressed to turn ON the peripheral fixed contact portion.

2. A multi-directional operating switch according to claim 1, wherein the inner bottom surface of the receptacle portion of the housing comprises a first inner bottom surface for disposing the central fixed contact portion thereon and a second inner bottom surface for disposing the peripheral fixed contact portions thereon, the first and second inner bottom surfaces being different in height from each other.

3. A multi-directional operating switch according to claim 2, wherein the first inner bottom surface is formed higher than the second inner bottom surface.

4. A multi-directional operating switch according to claim 2, wherein the first inner bottom surface is formed lower than the second inner bottom surface.

5. A multi-directional operating switch according to claim 1, wherein the stem comprises a base portion and a central stem portion, said central stem portion being slidably disposed through a central hole in the base portion.

6. A multi-directional operating switch according to claim 5, wherein the base portion is configured to engage the movable contacts disposed in opposition to the peripheral fixed contact portions, and the central stem portion is configured to engage the movable contact disposed in opposition to the central fixed contact portion.

7. A multi-directional operating switch according to claim 1, wherein the peripheral fixed contact portions comprise four fixed contact portions disposed at equally spaced positions about the central fixed contact portion.

8. A multi-directional operating switch according to claim 1, wherein the movable contacts each comprise a dome-shaped conductive metallic disk.

9. A multi-directional operating switch comprising:

a housing having a bottomed receptacle portion;

a central fixed contact portion disposed on an inner bottom surface of the receptacle portion;

peripheral fixed contact portions disposed at peripheral positions with respect to the central fixed contact portion;

a plurality of movable contacts disposed in opposition to the central fixed contact portion and the peripheral fixed contact portions; and a stem for selectively depressing the plurality of movable contacts so as to contact one of the central fixed contact portion and the peripheral fixed contact portions, wherein the movable contacts are disposed within the receptacle portion of the housing in such a manner that in the depressing direction of the stem the movable contact disposed in opposition to the central fixed contact portion and the movable contacts disposed in opposition to the peripheral fixed contact portions are spaced a predetermined distance from each other, while in a direction perpendicular to the stem depressing direction they partially overlap each other in their external forms, wherein the inner bottom surface of the receptacle portion of the housing comprises a first inner bottom surface for disposing the central fixed contact portion thereon and a second inner bottom surface for disposing the peripheral fixed contact portions thereon, the first inner bottom surface being formed higher than the second inner bottom surface.

10. A multi-directional operating switch according to claim 9, wherein the stem comprises a base portion and a central stem portion, said central stem portion being slidably disposed through a central hole in the base portion.

11. A multi-directional operating switch according to claim 10, wherein the base portion is configured to engage the movable contacts disposed in opposition to the peripheral fixed contact portions, and the central stem portion is configured to engage the movable contact disposed in opposition to the central fixed contact portion.

12. A multi-directional operating switch according to claim 9, wherein the peripheral fixed contact portions comprise four fixed contact portions disposed at equally spaced positions about the central fixed contact portion.

13. A multi-directional operating switch according to claim 9, wherein the movable contacts each comprise a dome-shaped conductive metallic disk.

14. A multi-directional operating switch comprising:

a housing having a bottomed receptacle portion;

a central fixed contact disposed on an inner bottom surface of the receptacle portion;

four peripheral fixed contact portions annularly disposed at equally spaced positions about the periphery of the central fixed contact;

a plurality of movable contacts disposed in opposition to the central fixed contact and each of the peripheral fixed contacts; and a stem for selectively and individually depressing each of the plurality of movable contacts so as to cause said movable contacts to contact with one of the central fixed contact and the peripheral fixed contacts, wherein the movable contact in opposition to the central fixed contact is disposed in a first plane that is perpendicular to the stem depressing direction, and the movable contacts in opposition to the peripheral fixed contacts are disposed in a second plane that is perpendicular to the stem depressing direction, said second plane being spaced apart from said first plane, wherein, in a direction perpendicular to the stem depressing direction, the movable contact in opposition to the central fixed contact partially overlaps each of the movable contacts in opposition to the peripheral fixed contacts, and wherein the stem can be selectively operated in both depressing direction and tilting direction so that when the stem is depressed, the movable contact disposed in opposition to the central fixed contact is depressed to turn ON the central fixed contact, while when the stem is tilted, the movable contact disposed in opposition to one of the peripheral fixed contacts is depressed to turn ON the peripheral fixed contact.

15. A multi-directional operating switch according to claim 14, wherein the inner bottom surface of the receptacle portion of the housing comprises a first inner bottom surface for disposing the central fixed contact thereon and a second inner bottom surface for disposing the peripheral fixed contacts thereon, the first and second inner bottom surfaces being disposed in different planes.

16. A multi-directional operating switch according to claim 15, wherein the first inner bottom surface is formed at a higher elevation than the second inner bottom surface.

17. A multi-directional operating switch according to claim 15, wherein the first inner bottom surface is formed at a lower elevation than the second inner bottom surface.

18. A multi-directional operating switch according to claim 14, wherein the stem comprises a base portion and a central stem portion, said central base portion being slidably disposed through a central hole in the base portion.

19. A multi-directional operating switch according to claim 18, wherein the base portion is configured to engage the movable contacts disposed in opposition to the peripheral fixed contacts, and the central stem portion is configured to engage the movable contact disposed in opposition to the central fixed contact.

20. A multi-directional operating switch according to claim 14, wherein the movable contacts each comprise a dome-shaped conductive metallic disk.

* * * * *